US006705937B2

(12) United States Patent
Huang et al.

(10) Patent No.: US 6,705,937 B2
(45) Date of Patent: Mar. 16, 2004

(54) AIRFLOW CAPTURE BOOTH WITH SINGLE-PLATE WINDBREAK

(75) Inventors: Rong Fung Huang, Taipei (TW); Yu-Kang Chen, Kway-Jen (TW); Wen-Yu Yeh, Shijr (TW); Chun-Wan Chen, Shijr (TW); Jin Hsun Liu, Jang-Hua Shang (TW)

(73) Assignee: Institute of Occupation Safety and Health, Council of Labor Affairs Executive Yuan, Taipei (TW)

( * ) Notice: Subject to any disclaimer, the term of this patent is extended or adjusted under 35 U.S.C. 154(b) by 116 days.

(21) Appl. No.: 10/171,665

(22) Filed: Jun. 17, 2002

(65) Prior Publication Data

US 2003/0232589 A1 Dec. 18, 2003

(51) Int. Cl.[7] ..... B08B 15/00
(52) U.S. Cl. ..... 454/49; 73/147
(58) Field of Search ..... 454/49, 63, 65, 454/67; 73/147

(56) References Cited

U.S. PATENT DOCUMENTS

| | | | | | |
|---|---|---|---|---|---|
| 536,097 | A | * | 3/1895 | Reading | 126/242 |
| 2,855,837 | A | * | 10/1958 | Bakke | |
| 4,284,236 | A | * | 8/1981 | Bradshaw | 236/49.3 |
| 4,896,532 | A | * | 1/1990 | Schmalz | 73/147 |
| 5,133,691 | A | * | 7/1992 | Karlsson | 454/56 |
| 6,036,592 | A | * | 3/2000 | Rubin | 454/63 |

* cited by examiner

*Primary Examiner*—Harold Joyce
(74) *Attorney, Agent, or Firm*—Troxell Law Office PLLC

(57) ABSTRACT

The present invention discloses an airflow capture booth with single-plate windbreak comprising an extracting means for extracting polluted air having an opening for air contamination extracting through and a crosswind device for simulating crosswind, the improvement comprises that said crosswind device having a single-plate windbreak perpendicular to an airflow direction of said crosswind having a specific distance to said opening of said extracting means for forming a capture zone, wherein the airflow of said capture zone is not easy to be shed and is extracted mostly by said extracting means.

4 Claims, 14 Drawing Sheets

AIRFLOW CAPTURE BOOTH WITH SINGLE-PLATE WINDBREAK

FIELD OF THE INVENTION

The invention herein relates to an unblocked airflow capture booth, particularly relates to an airflow capture booth with single-plate windbreak for extracting the air contamination, which may form a capture zone before extracting out for effetely cleaning the air contamination.

BACKGROUND OF THE INVENTION

It is common in general operation area to use an disclosed airflow extracting apparatus for air contamination such as vapours, dusts, smokes, and hot steam. The air contamination will not shed out to the operation area by using an extracting apparatus. The evaluation of the capture ability of the extracting apparatus usually depends on the control of the air contamination. In general, the capture ability of the extracting apparatus further depends on the extracting volume, the relative space and distance of the air contamination, even the shape of the apparatus.

To extract the air contamination always is an important problem to be solved. Therefore, it provides various ventilation system (air induction/exhauster) in the market. There are two traditional types for ventilation system; one is full-enclosed and the other is disclosed system. FIG. 1A and FIG. 1B illustrate the full-enclosed airflow capture booth, which may confine the air contamination to the inner shielding space. It may provide a better efficiency of extracting, however, which cost a lot and is not flexible for operation, particularly, it needs a larger space to put the whole system. It also causes users not using that system for extracting air contamination.

Though the cost of the traditional disclosed airflow extracting apparatus is cheaper and more convenient for operation, it may be influenced by the crosswind such as induction airflow by operator moving, or thermal diffusion fans in the operation area etc.

When crosswind happened in a disclosed airflow ventilation system, even only a very tiny airflow (a few centimeters per second), it may cause the airflow shed near the exhaust opening. FIG. 2A and FIG. 2B show the change of the airflow, which may have a capture zone under the hood and expose out after the extracting apparatus works. In another word, if the air contamination is located under the hood as shown in FIG. 2A, when crosswind happened, the air contamination may be escaped from the capture zone of the hood as shown in the FIG. 2B, and may cause the problem of air contamination being exposed.

Therefore, it is important to provide a flexible system for operation when extracting the air contamination, and further protect air contamination from the capture zone of the hood caused by the crosswind. The present invention takes the advantages of the hydrodynamics to invent an airflow capture booth by active control. It may decrease the influence caused by the crosswind and remain the flexible operation when extracting the air contamination. Furthermore, it may keep the air contamination in a capture zone efficiently and avoid the air contamination exposed out to extract by the system.

OBJECTS OF THE INVENTION

The present invention provides a disclosed airflow capture booth for decreasing the influence of the crosswind.

One of the objects of this invention is to provide a high efficient airflow capture booth for air contamination to reduce and improve the operation environment pollution.

Another object of this invention is to provide a power saving airflow capture booth by efficiently using thereof, which may protect the operation environment for occupational safety and health, and further to improve the national productivity.

The other object of this invention is to provide an application to solve the problems of industry pollution caused by the crosswind. And the crosswind may be caused by opening or shutting doors or windows, or operators moving around etc. Therefore, this invention is provided for solving the problems of air contamination exposed out of hood. It may further contribute not only for industry but for the exhaust fan when using at home.

SUMMARY OF THE INVENTION

An airflow capture booth with single-plate windbreak comprising an extracting means for extracting polluted air having an opening for air contamination extracting through and a crosswind device for simulating crosswind, the improvement comprises that said crosswind device having a single-plate windbreak perpendicular to an airflow direction of said crosswind having a specific distance to said opening of said extracting means for forming a capture zone, wherein the airflow of said capture zone is not easy to be shed and is extracted mostly by said extracting means.

BRIEF DESCRIPTION OF THE DRAWINGS

The present invention will be better understood from the following detailed description of preferred embodiments of the invention, taken in conjunction with the accompanying drawings, in which.

DESCRIPTION OF THE PREFERRED EMBODIMENTS

The following descriptions of the preferred embodiments are provided to understand the features of the present invention.

An external type suction-hood apparatus is very common for general factories to improve their air contamination in the operation area. The cross draft is a deterministic factor to the performance of an external type suction-hood which operates in an open atmosphere. In general, the capture ability depends on the extracting volume, the relative space and distance of the air contamination source, even the shape of the apparatus. Besides, the airflow (crosswind) influences the external suction-hood including: 1. some other ventilation system, such as the whole atmosphere cycling, air conditioner, or thermal diffusion fan etc; 2. moving airflow caused by the process itself, such as vapor generated by the electroplating material; 3. open operation area inducing the airflow; and 4. operators' moving or the machine's operating, such as operator's walking or shutting down the machine. The three formers may exist long term, which may decrease the capture ability. Especially, workers always use the electric fan for the summer time, and it may be caused unstable airflow in the operation area. Furthermore, it may influence the capture ability of the suction-hood apparatus. Therefore, it is important to provide an airflow capture booth without being influenced by the crosswind, and further to improve extraction for the air contamination.

Figure 4A:
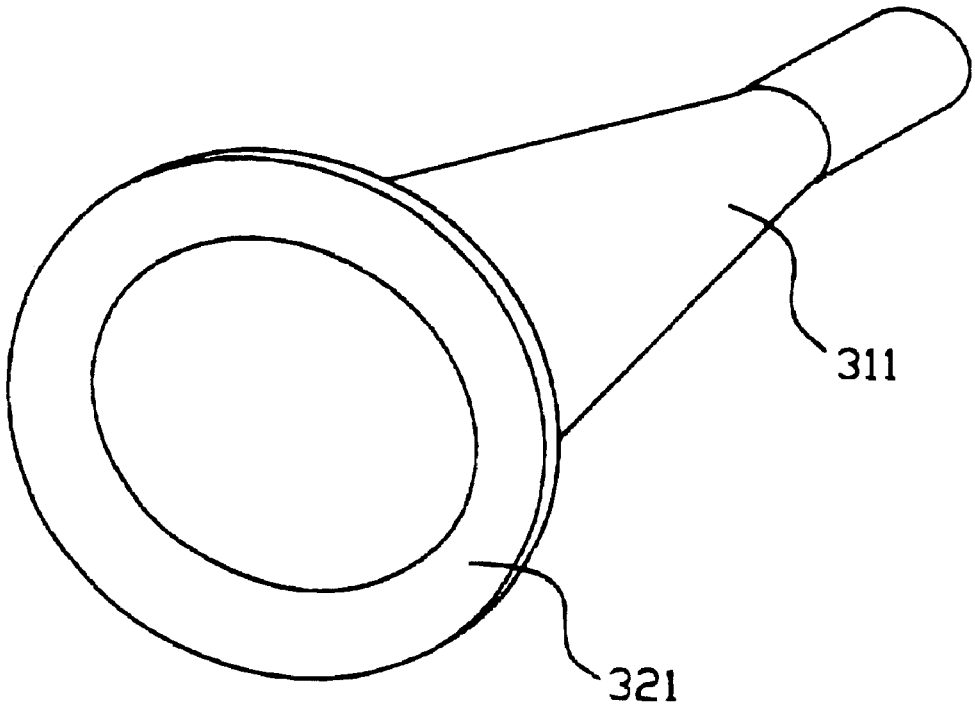
FIG. 4A and FIG. 4B show different hoods and flanges respectively.
Figure 4B:
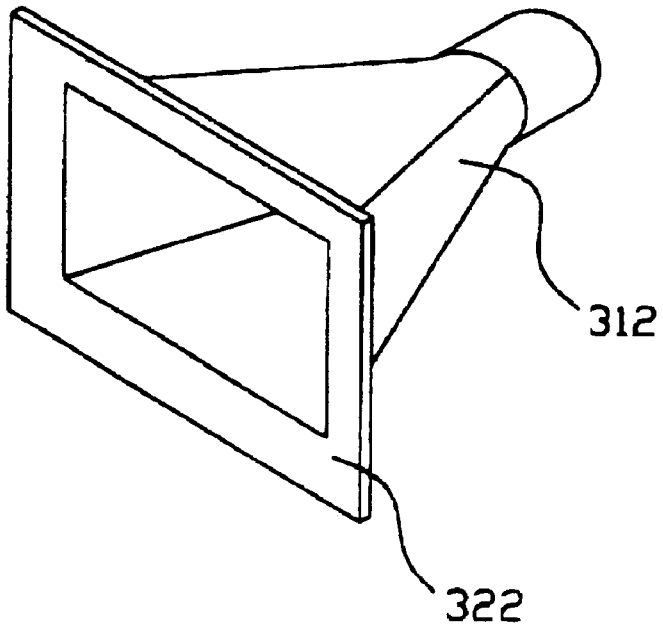

The present invention provides an airflow capture booth with single-plate windbreak, which comprises an extracting means 31, a flange 32 connecting with said extracting means 31. It may adapt a fan in another end of the extracting means 31 for induction and/or extraction through said means 31 and said flange 32 to extract the air contamination. Furthermore, said extracting means 31 and said flange 32 may be embodied in other specific forms, which depend on the demand of the operation area. For example, a round flange 321 is connected with a conical extracting means 311 as shown in FIG. 4A. Or, it may be shaped in a square flange 322 connected with a pyramid extracting means 312. Moreover, the present invention also comprises a crosswind device 33 for simulating crosswind. Particularly, the improvement of this invention comprises that said crosswind device 33 having a single-plate windbreak 331 perpendicular to an airflow direction of said crosswind having a specific distance to said opening of said extracting means 31 for forming a capture zone 50 (as shown in the FIG. 5C), wherein the airflow of said capture zone 50 is not easy to be shed and is extracted mostly by said extracting means 31.

For example, the present invention adapts a wind tunnel to simulate a low-speed uniform crosswind for observing its flow field and further for its capture ability. The extracting means 31 locates on the upper portion of the crosswind device 33 (such as the wind tunnel) for measuring the velocity and the volume of airflow (such as heated-thermometer anemometer and venture flow meter, etc.). A flow straightener may be adapted for controlling the airflow when measuring the velocity and the volume thereof. Furthermore, a laser Doppler velocimetry may be adapted for measuring its airflow.

Figure 1A:
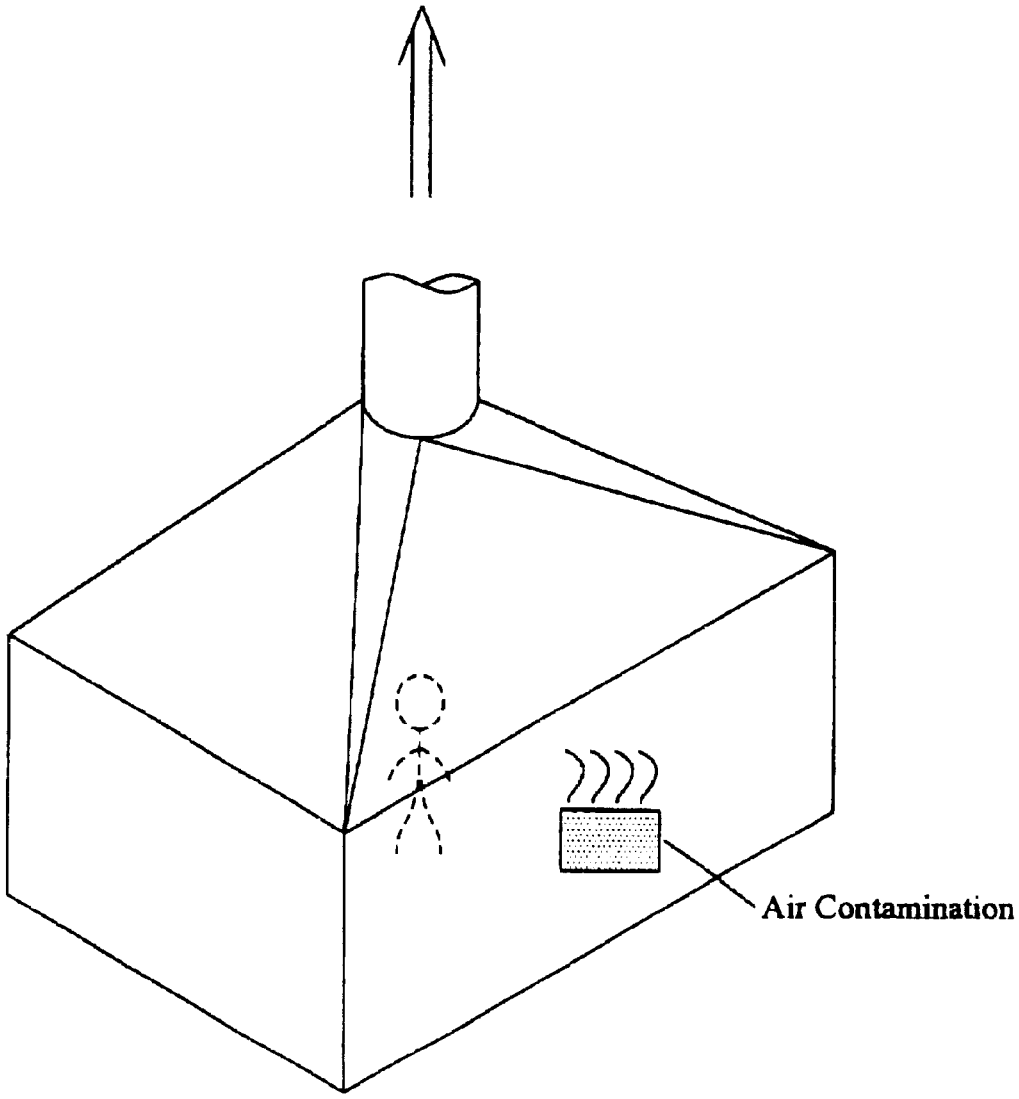
FIG. 1A (Prior Art)
FIG. 1A and FIG. 1B show prior art of full-enclosed extracting apparatus.
Figure 1B:
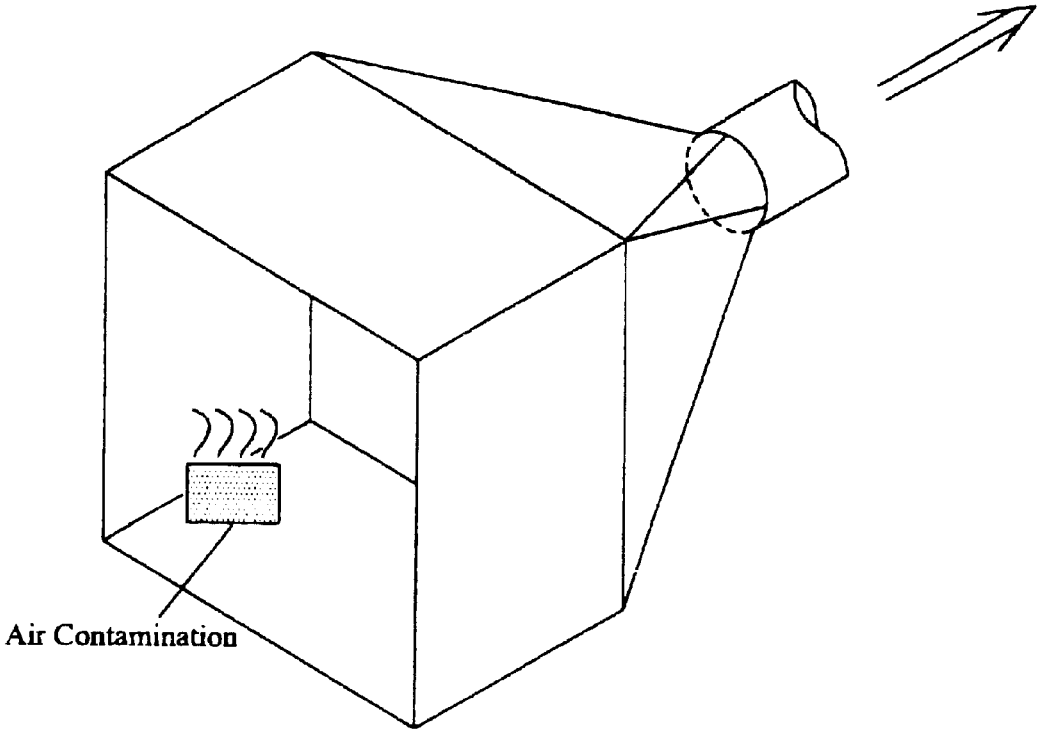
FIG. 1B (Prior Art)
Figure 2A:
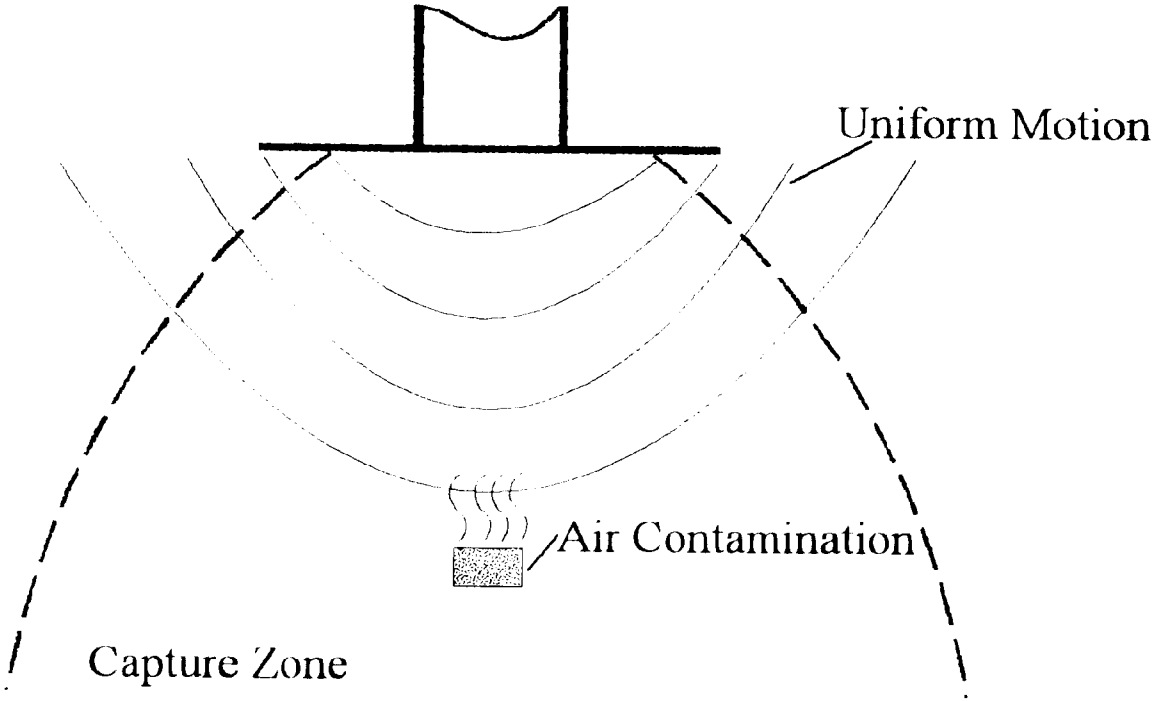
FIG. 2A illustrates a normal flow field.
Figure 2B:
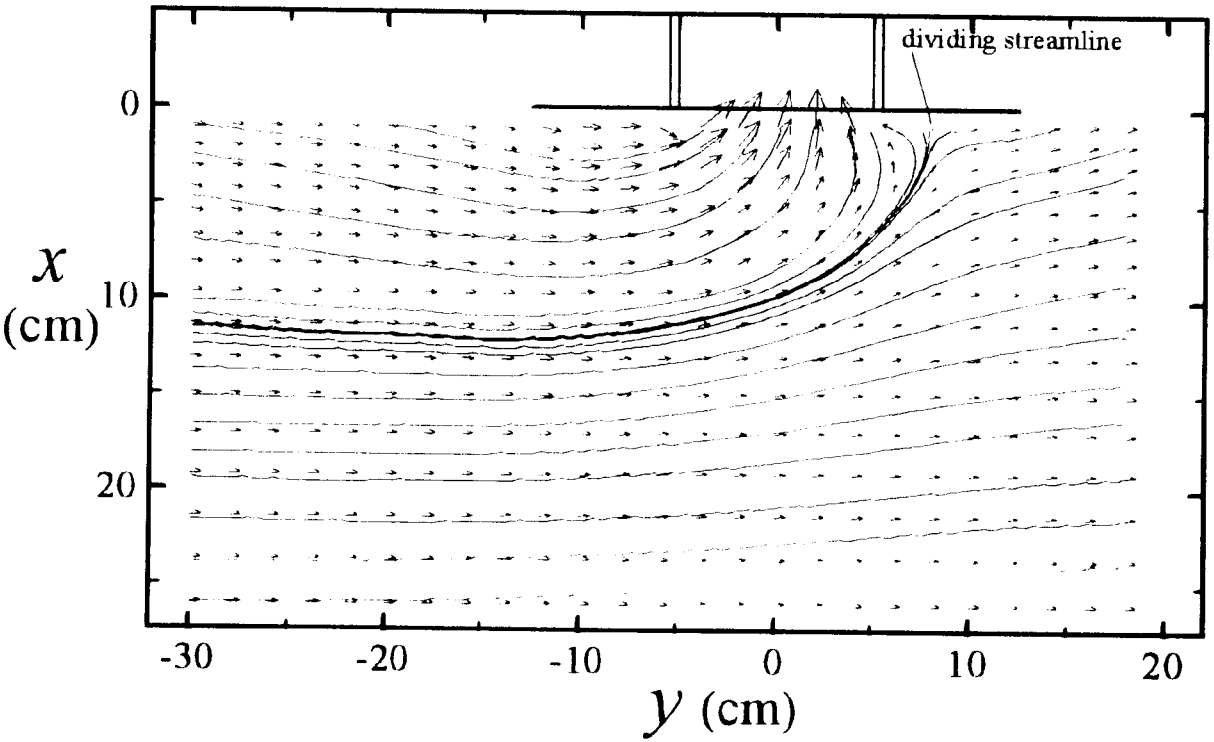
FIG. 2B illustrates a flow field generated by crosswind.
Figure 3A:
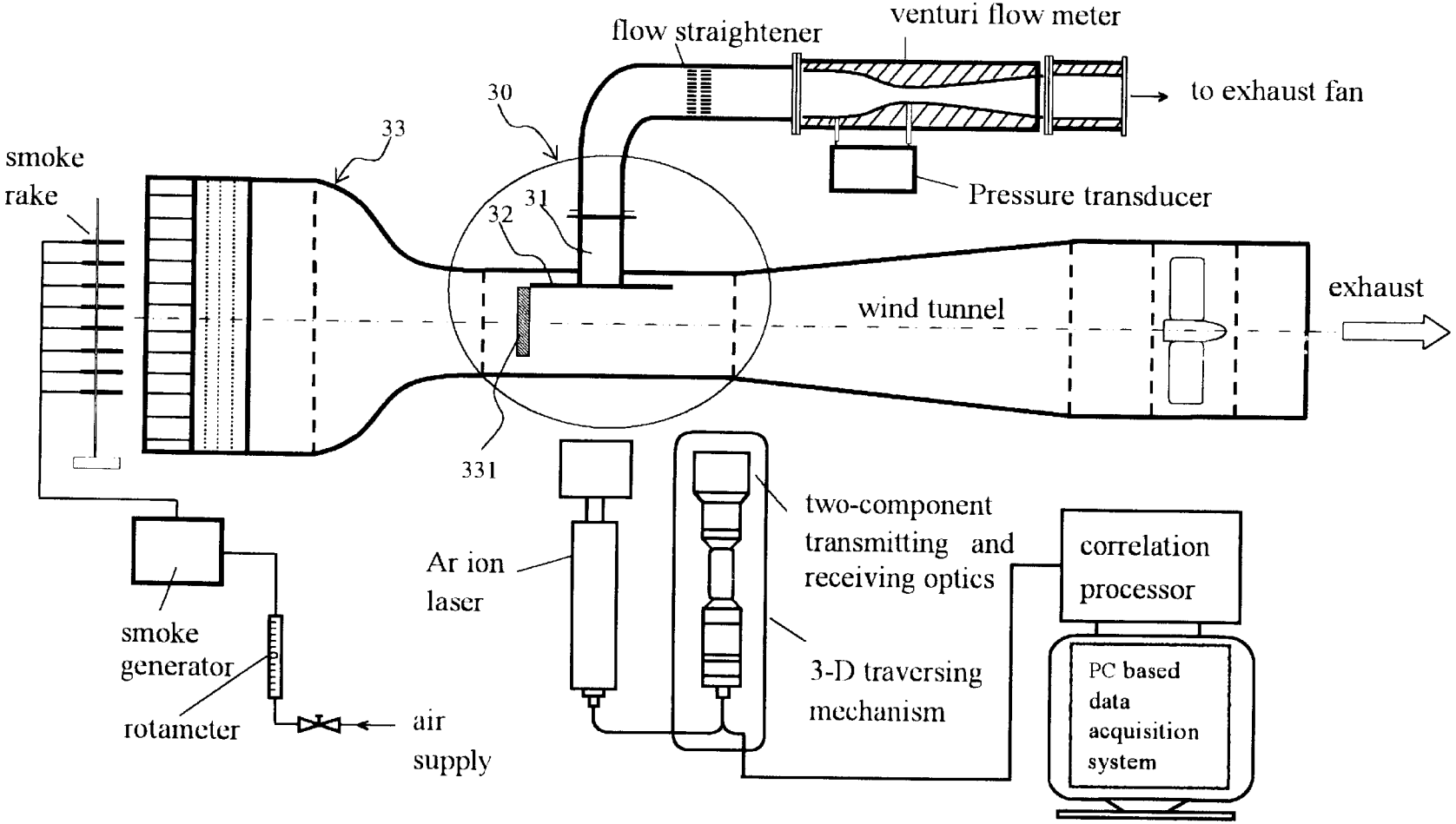
FIG. 3A is the embodiment example of the present invention.
Figure 3B:
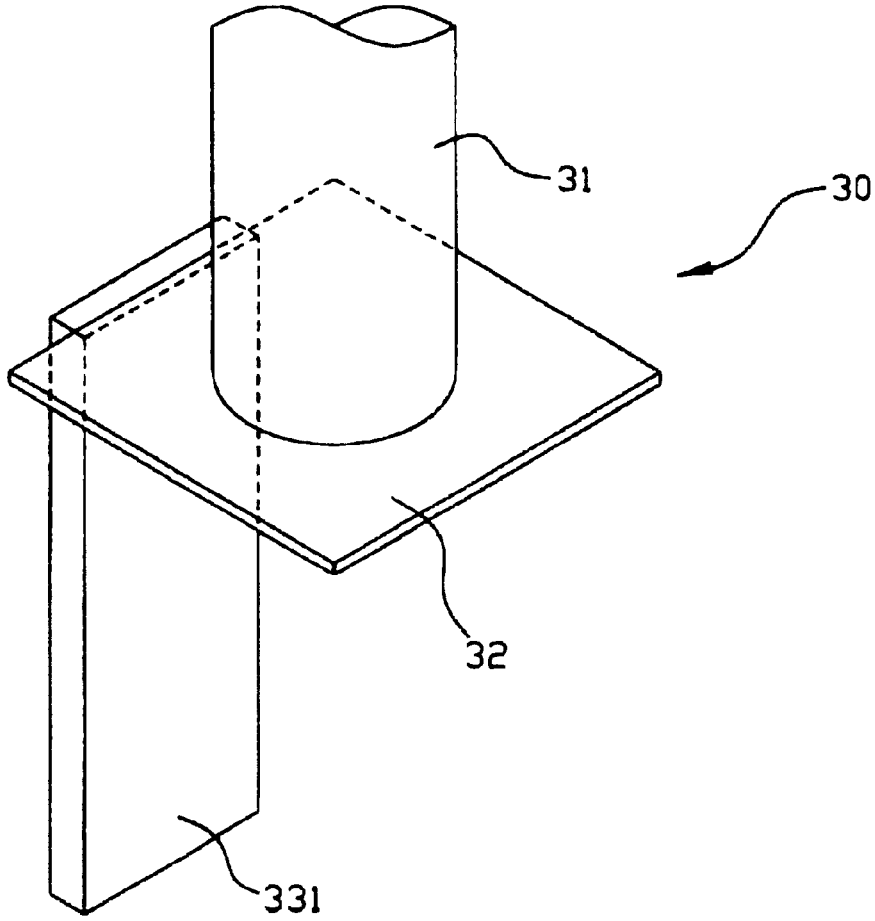
FIG. 3B~FIG. 3D illustrates enlarge views of the embodiment example according to FIG. 3A.
Figure 3C:
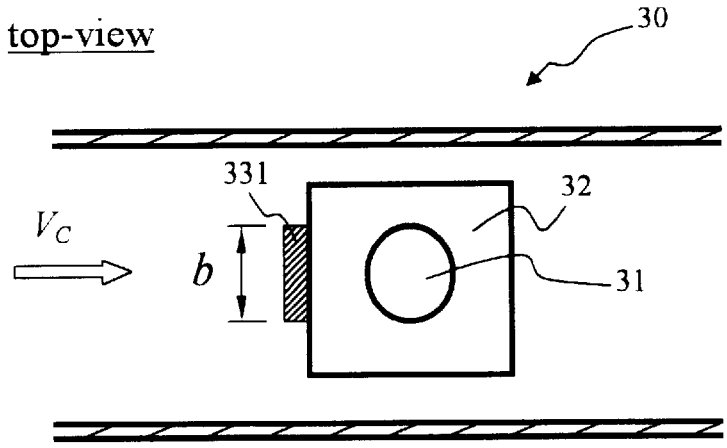
Figure 3D:
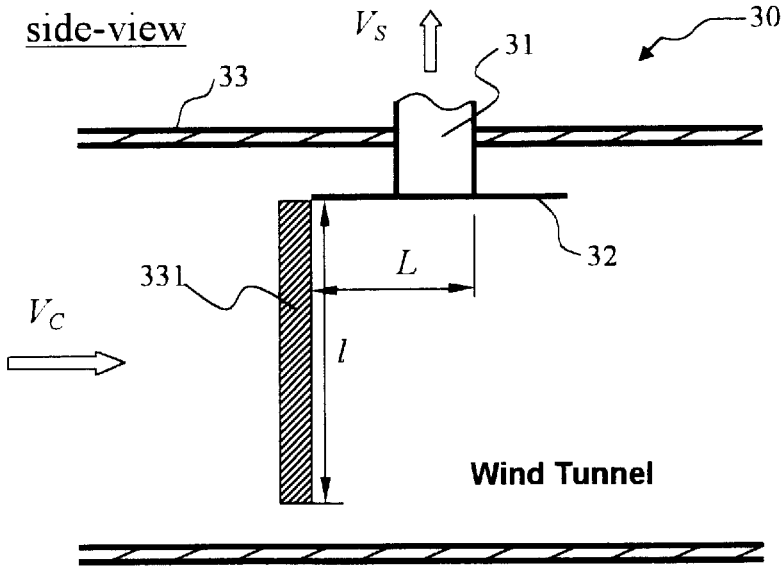

Please see the FIG. 3B~3D, which show the enlarge view of the embodiment of this invention. The single-plate windbreak 331, extracting means 31, and flange 32 provided by this invention has shown in FIG. 3B (cross-section view), FIG. 3C (top view), and FIG. 3D (side view). The design parameters of the single-plate windbreak 331 including its distance with extracting means 31 "L", its width "b", and its length "I". For considering the dynamic vortex shedding (as shown in FIG. 5A), the location of the extracting means 31 is on the top of the recirculation area 50 (as shown in FIG. 5C) to make "L=Lr", wherein the "Lr" may be obtained by the Reynolds number calculation.

When the parameter of velocity "Vc" of the crosswind and the width of the single-plate windbreak has decided, the value of "Lr" can be obtained. Therefore, the distance "L" may be set between the windbreak 331 and the extracting means 31.

Figure 5A:
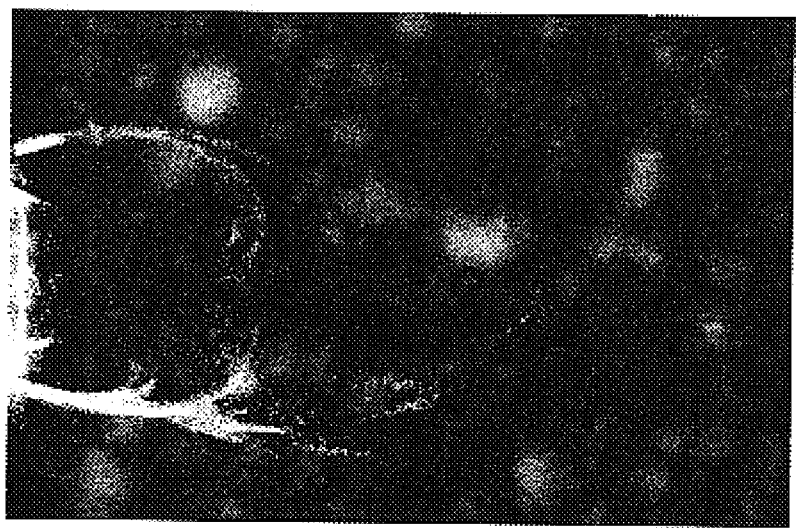
FIG. 5A show a picture and an illustration of dynamic vortex shedding.
Figure 5A:
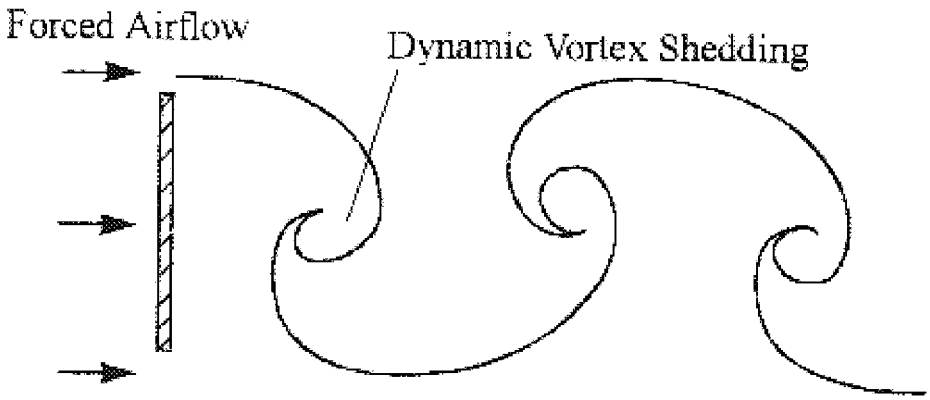
Figure 5B:
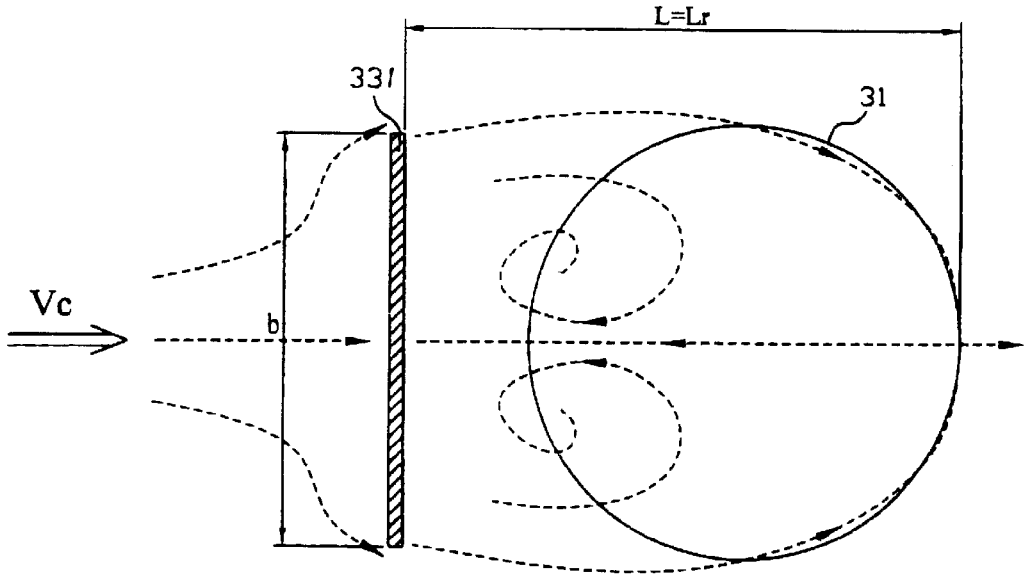
FIG. 5B~FIG. 5C illustrate capture zone with recirculation.
Figure 5C:
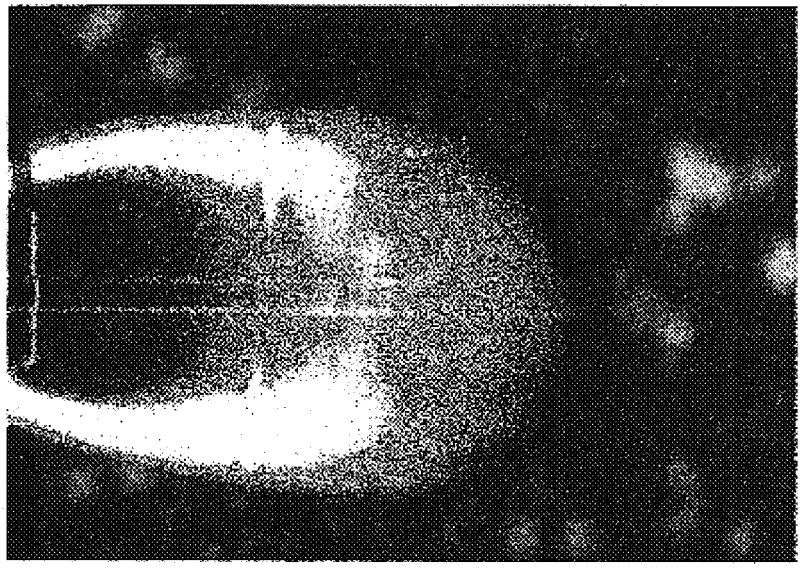
Figure 5C:
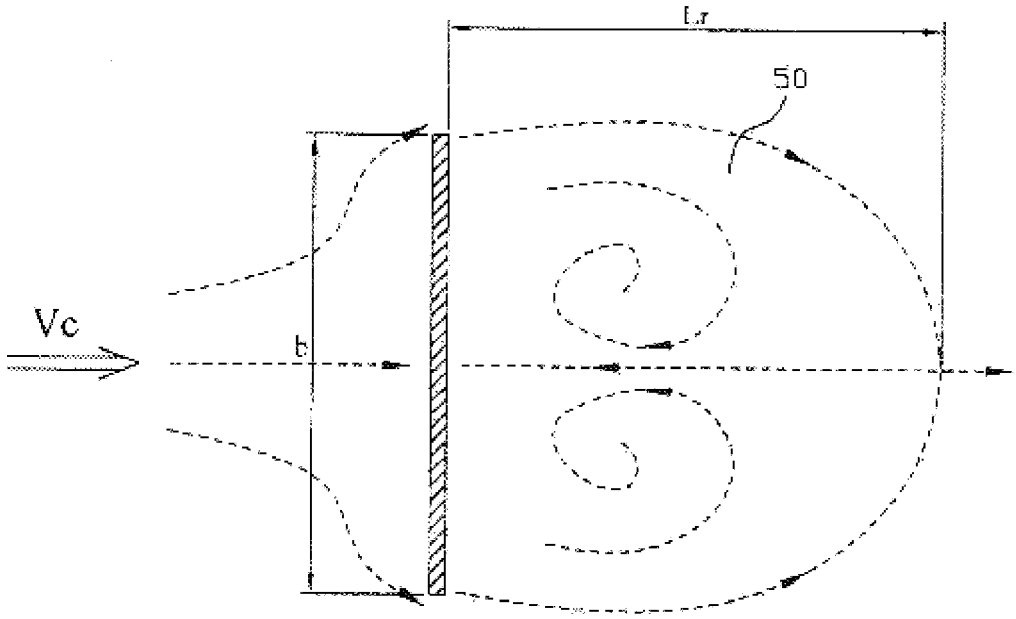
Figure 6A:
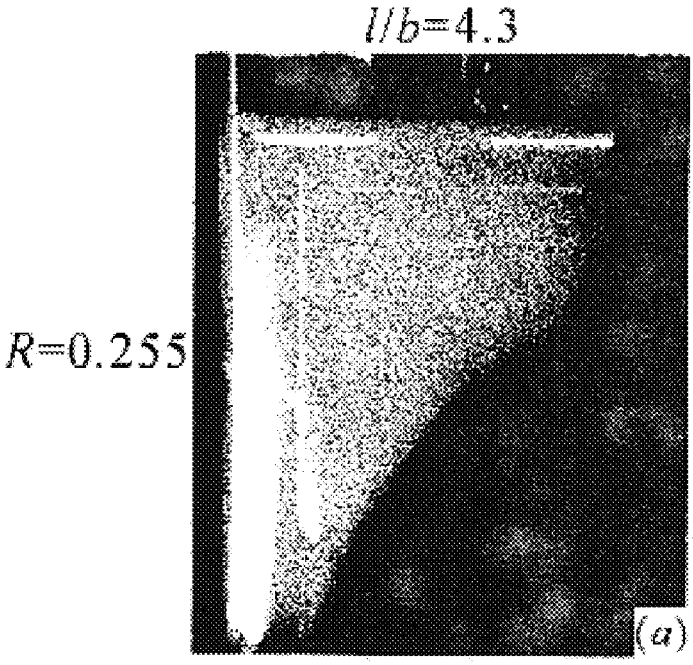
FIG. 6A and FIG. 6B show a picture and an illustration of flow field in accordance with an embodiment example of this invention.
Figure 6B:
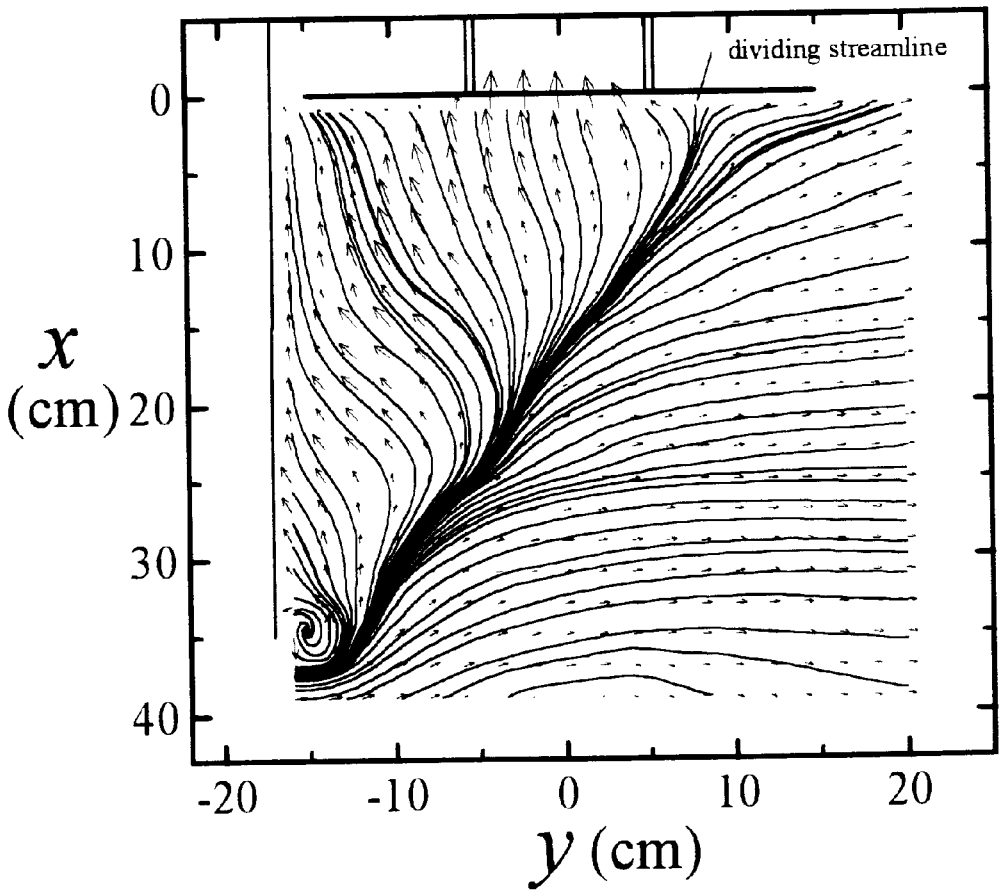

When only the wind tunnel 33 is on, shown in the FIG. 5A, the windbreak 331 is forced with a crosswind, and it will generate a vertex shedding effect. Due to the reverse pressure and the flow field unstable happened in the lower airflow behind the windbreak 331, it forms a dynamic vertex shedding as shown in FIG. 5A. When both of the wind tunnel 33 and extracting means 31 are on, the vertex shedding will be disappeared by the single-plate windbreak 331 working as shown in the FIG. 5B and FIG. 5C. Furthermore, the capture zone 50 (recirculation) will be formed stably. FIG. 6A and FIG. 6B show a picture and an illustration of flow field respectively. It has proofed the disappearance of vertex shedding by the viewable technology and the measuring equipment. The steady capture zone 50 is very large, which relates to the ability of the extracting means 31 and the size of the windbreak 331. The capture zone is like a invisible air curtain, which provides a better efficiency for extracting the air contamination. In a specific environment, this curtain may highly against the crosswind from any direction, further decrease the influence of the crosswind for extracting means.

The present invention may be embodied in other specific forms without departing from the spirit of the essential attributes thereof; therefore, the illustrated embodiment should be considered in all respects as illustrative and not restrictive, reference being made to the appended claims rather than to the foregoing description to indicate the scope of the invention.

What is claimed is:

1. An airflow capture booth with single-plate windbreak comprising an extracting means for extracting polluted air having an opening for air contamination extracting through and a crosswind device for simulating crosswind, the improvement comprises:

said crosswind device having a single-plate windbreak perpendicular to an airflow direction of said crosswind having a specific distance to said opening of said extracting means for forming a capture zone, wherein the airflow of said capture zone is not easy to be shed and is extracted mostly by said extracting means.

2. The airflow capture booth of claim 1, wherein said crosswind device simulates uniform-like crosswind.

3. The airflow capture booth of claim 1, wherein said opening is in round shape.

4. The airflow capture booth of claim 1, wherein said opening is in square shape.

* * * * *